United States Patent [19]

Hutchinson

[11] Patent Number: 5,005,236

[45] Date of Patent: Apr. 9, 1991

[54] INFLATABLE PRODUCTS

[75] Inventor: Peter M. Hutchinson, Harrogate, Great Britain

[73] Assignee: Mountain Equipment Limited, Stalybridge, United Kingdom

[21] Appl. No.: 424,287

[22] PCT Filed: Mar. 4, 1987

[86] PCT No.: PCT/GB87/00151

§ 371 Date: Oct. 26, 1989

§ 102(e) Date: Oct. 26, 1989

[87] PCT Pub. No.: WO88/06421

PCT Pub. Date: Sep. 7, 1988

[30] Foreign Application Priority Data

Jan. 10, 1986 [GB] United Kingdom ..... 8600534

[51] Int. Cl.[5] ..... A47G 9/08; A47C 27/08; A47C 27/12

[52] U.S. Cl. ..... 5/413; 5/450; 5/482; 5/502; 2/DIG. 3; 428/74

[58] Field of Search ..... 5/413, 450, 448, 449, 5/482, 502; 2/69.5, DIG. 3; 428/74

[56] References Cited

U.S. PATENT DOCUMENTS

| | | | |
|---|---|---|---|
| 1,332,933 | 3/1920 | Sylvester . | |
| 2,620,493 | 12/1952 | Brelsford . | |
| 2,997,100 | 8/1961 | Morris . | |
| 3,206,776 | 9/1965 | Moore | 5/450 |
| 4,091,482 | 5/1978 | Malcolm . | |
| 4,261,776 | 4/1981 | Lea et al. | 5/450 |

FOREIGN PATENT DOCUMENTS

| | | |
|---|---|---|
| 910402 | 6/1946 | France . |
| 428124 | 7/1967 | Switzerland . |
| 1526389 | 9/1978 | United Kingdom . |
| 1535316 | 12/1978 | United Kingdom . |

*Primary Examiner*—Alexander Grosz
*Attorney, Agent, or Firm*—Armstrong, Nikaido, Marmelstein, Kubovcik & Murray

[57] ABSTRACT

A sleeping mat (4), preferably forming part of a sleeping bag (2), comprises an inflatable enclosure (10) containing a fibrous bat (12) which is attached to the opposite sides of the enclosure so that on inflation thereof the bat is non-resiliently expanded.

9 Claims, 1 Drawing Sheet

INFLATABLE PRODUCTS

Figure 1:
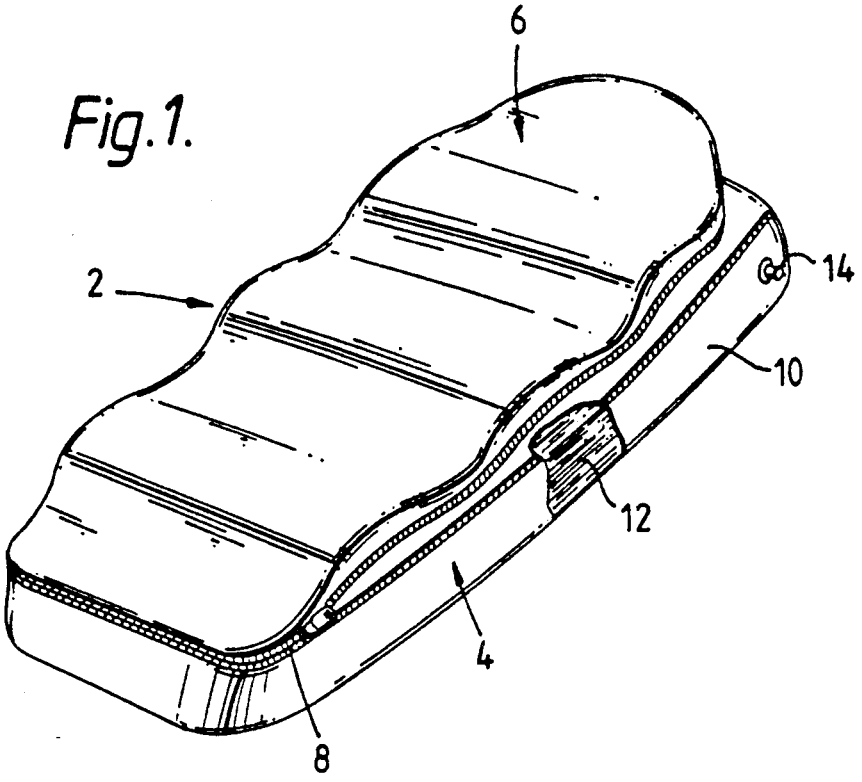

This invention relates to inflatable products, and particularly but not exclusively to an inflatable product used as the base of a sleeping bag.

GB No. 1,535,316 describes a sleeping bag having inflatable upper and lower mats containing a heat-insulating material formed of a plurality of strips of metallized plastics film. The bag is said to provide better protection, to be lighter in weight, and to have an improved life expectancy compared with existing sleeping bags, and to have an advantage over conventional inflated air beds by the fact of being filled with material which will reduce heat loss by convenction.

The metallized plastics film is said to have a greater life expectancy than the down traditionally used because it is less susceptible to wetting. However, it is necessary for the strips of plastics material to be resilient so as to provide the insulating filler with sufficient loft properties in order to achieve filling of the interior of the inflatable mat. This imposes a limit on the lifetime of the sleeping bag because the filling material tends to "tire", so that given sufficient time and use the material tends to lose its resiliency and accordingly the lofting properties deteriorate and the thermal insulation and comfort provided by the sleeping bag is impaired. A further disadvantage is that inflating the mat beyond a certain amount will impair the efficiency of the filling material because of the limit to its lofting properties. In either case the inflated air space will only be partially filled with the material and heat loss by convection will arise.

The present invention is directed to an improvement on the proposals in GB No. 1,535,316, and provides an inflatable product which in a preferred form is a sleeping mat, and preferably is one which can form the base of a sleeping bag. However the invention has uses in other areas; for example, the product may be used as a garment, a bed quilt, upholstery, etc.

According to one specific aspect of the invention, an inflatable product, preferably a sleeping mat, comprises an inflatable enclosure containing a fibrous bat attached to opposite sides of the closure so that the bat can be lofted by the movement apart of the opposite sides on inflation of the enclosure.

Another aspect of the invention provides an inflatable product, preferably a sleeping mat, comprising an inflatable enclosure containing and attached to a filling material which can be expanded substantially nonresilently, and which preferably substantially fills the enclosure.

The invention also extends to such a product when inflated. Preferably, the enclosure has an inflation aperture by means of which it can be inflated preferably by air. This is not absolutely necessary: the product could instead be inflated on manufacture and thereafter maintained inflated permanently. This may be useful for products sold as part of, or to be incorporated in, certain types of goods, although this would of course not be the preferred arrangement if the product is to be used as, e.g., a sleeping bag.

By attaching the filling material to the enclosure, the lofting of the material is caused, or at least assisted, by the inflation of the enclosure, so that it is no longer necessary to rely on the resilience of the filling material. This results in a much greater life expectancy, and a greater variety of materials from which the filler can be selected including materials of the highest proven thermal efficiency. Although the filling material as a whole is, preferably, substantially nonresiliently expandable, it may be made of individual components which are themselves resilient.

It is to be noted that an important advantage of the invention results from the ability to form products having an extended life using filler materials which are of excellent thermal efficiency but which at present are too non-resilient to give adequate performance in use.

Preferably, a bat of synthetic fiber is used as the filling.

The filling is preferably bonded to the inner surface of the enclosure, preferably by the application of heat.

Figure 2:
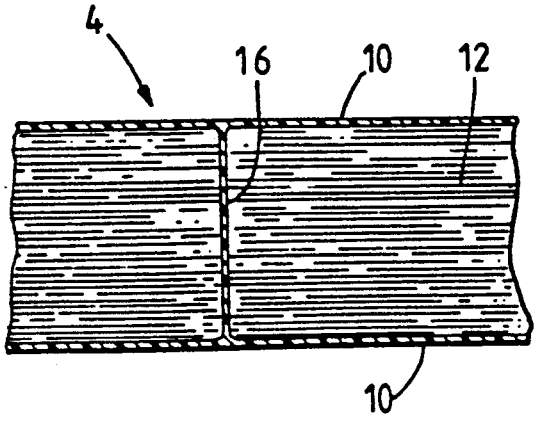

An arrangement embodying the invention will now be described by way of example with reference to the accompanying drawings, in which:

FIG. 1 is a perspective view of a sleeping bag in accordance with the invention, and FIG. 2 is a section view showing a small part of the base of the sleeping bag of FIG. 1.

The sleeping bag 2 of FIG. 1 comprises a base 4 and a top 6. The two are joined together by a zipper 8, to permit the base to be used with a variety of different tops. Instead of a zipper, other fastenings could be used, such as press-studs, ties, or a combination of a tufted hook fabric and a matching tufted loop fabric (e.g., Velcro, which is a Registered Trade Mark). Alternatively, the top and base could be sewn together.

The top 6 may be conventional (e.g. a nylon case filled with down or synthetic filling). If the base is intended to be used with interchangeable tops, the tops could have different insulation thicknesses and/or materials to give different insulation performances.

The base 4, shown partly cut-away, comprises an outer enclosure 10 formed of light, tough and substantially air-impermeable material. It would be possible to use nylon, polyester/cotton or Goretex, by way of example, if necessary treating the material (e.g. by rubberizing or plasticizing it) to provide impermeability. Alternatively, such materials could be used as an outer shell within which is situated an impermeable enclosure of a different material.

The enclosure contains filling material forming a bat indicated at 12. Preferably, the bat is formed of synthetic fibers, e.g. polyester, Dacron, Terylene, polypropylene, viscose, etc. The fiber may come in the form of a short staple (e.g. 5 to 15 cm long) or a continuous filament. In either event, the fiber are preferably crimped to give them springiness and to improve their natural loft properties.

Such fiber bats are in themselves known. In the present invention, however, the bat is laid within the impermeable enclosure, and the upper and lower surfaces of the bat are bonded to the inner sides of the upper and lower parts of the enclosure. Bonding is achieved by heat treatment, e.g. by heat applied to the fiber to soften them or preferably by using a thermo-bonding adhesive. Other methods of attachment, e.g. using an adhesive without applying heat, are possible. If desired, the entire upper and lower surfaces may be attached. Alternatively, there may simply be lines or points of attachment.

The enclosure has an inflation aperture indicated at 14, by means of which the base can be inflated by mouth or bellows. A plug (not shown) is provided to close the aperture, as in conventional air-beds.

Such an arrangement provides a light, comfortable and thermally efficient sleeping bag. It will be appreciated that the degree of inflation can be selected by the user, and that irrespective of the degree of inflation the fibrous bat will expand substantially to fill the entire enclosure.

In addition, compression of the base 4 for packing and transporting the sleeping bag can be carried out very easily and without undue effort on deflation thereof, particularly as there is no need for a filler which relies upon its bulk and its resiliency to provide adequate lofting properties.

Although a synthetic fibrous bat is presently preferred as the filling material, there are other possibilities. Down could be used, but is not preferred because of the difficulties in bonding it to the enclosure. A fiber pile filler could be used (i.e. a fabric with a pile rising from a knitted or woven back) although this is not preferred as it is relatively heavy and not very compressible. Crimped metallized plastics strips could be used, or possibly a foam (open cell to permit compression). Whatever filler is used, it is very desirable that it be capable of attachment to the enclosure so that it is expanded upon inflation of the enclosure, and that the expansion neither rely on nor be inhibited by the resiliency of the filler to any great extent.

If desired, the interior of the enclosure 10 can be separated by partitions 16 (see FIG. 2) to reduce air convection currents. A separate fibrous bat could be provided within each of the partitioned compartments. Apertures would be provided, preferably within the partitions, to permit inflation.

It would be possible to use an inflatable product like the base 4 as the top of the sleeping bag.

As indicated above, inflated or inflatable products in accordance with the invention can be used for other purposes. Specific examples include garments such as a thermally protective suit (for use for example when flying in helicopters) which is worn or carried uninflated but is capable of inflation when desired. Such a suit is particularly useful in air-sea rescue operations in which case the suit can be inflated before the wearer is immersed in water.

Another possibility would be to use an inflatable product in accordance with the invention to form a cover for an inflatable raft which again would be useful in sea rescue operations. The cover would extend over the occupants of the raft and protect them from wind and cold weather. The cover could be inflatable automatically and possibly using the same devices as used to inflate the raft base, for which purpose the interior of the base and the interior of the cover may communicate with each other.

An inflatable product in accordance with the invention may also be used for an emergency blanket for which purpose it could be carried for example in an ambulance where, when uninflated, it can be packed in a very compact manner.

I claim:

1. An inflatable product comprising an inflatable enclosure; filling material provided within and substantially filling the enclosure and attached to opposite sides of the enclosure; the filling material being at least one fibrous bat substantially expandable by the movement apart of the opposite sides of the enclosure caused by inflation of the enclosure.

2. An inflated product comprising an enclosure containing gas under pressure; filling material provided within and substantially filling the enclosure and attached to opposite sides of the enclosure; the filling material being at least one fibrous bat having been substantially expanded by the movement apart of the opposite sides of the enclosure caused by the inflation of the enclosure by the gas.

3. A product as claimed in claim 1 or 2, wherein the fibrous bat is made of synthetic fibers.

4. A sleeping mat formed by a product as claimed in claim 3.

5. A product as claimed in claim 1 or 2, wherein the filling material does not substantially inhibit the movement apart of the opposite sides of the enclosure.

6. A sleeping mat formed by a product as claimed in claim 5.

7. A product as claimed in claim 1 or 2, wherein the interior of the enclosure is partitioned, each partitioned section containing the filling material.

8. A sleeping mat formed by a product as claimed in claim 1 or 2.

9. A sleeping bag comprising a base formed of a sleeing mat as claimed in claim 8 and a top attached or attachable to the base.

* * * * *